United States Patent [19]

Mattiuzzo

[11] Patent Number: 5,001,850

[45] Date of Patent: Mar. 26, 1991

[54] SKI BOOT WITH SLOPE ADJUSTMENT

[75] Inventor: Mario Mattiuzzo, Treviso, Italy

[73] Assignee: Lange International S.A., Fribourg, Switzerland

[21] Appl. No.: 410,158

[22] Filed: Sep. 20, 1989

[30] Foreign Application Priority Data

Oct. 4, 1988 [CH] Switzerland ..... 3693/88

[51] Int. Cl.[5] ..... A43B 5/04; A43B 5/16

[52] U.S. Cl. ..... 36/117; 36/121

[58] Field of Search ..... 36/117, 118, 119, 120, 36/121

[56] References Cited

U.S. PATENT DOCUMENTS 4,599,813 7/1986 Sartor ..... 36/117
4,601,117 7/1986 Leonardi ..... 36/120
4,677,770 7/1987 DeMarchi et al. ..... 36/117
4,693,020 9/1987 Salas et al. ..... 36/117
4,841,650 6/1989 Dodge et al. ..... 36/119

*Primary Examiner*—Steven N. Meyers
*Assistant Examiner*—M. D. Patterson
*Attorney, Agent, or Firm*—Kane, Dalsimer, Sullivan, Kurucz, Levy, Eisele and Richard

[57] ABSTRACT

Boot consisting of a shell (1) onto which is articulated an upper in one or two parts (2, 4), comprising means for holding the upper in a sloping position and for modifying its slope. These means consist of an end stop (5) formed on the shell and of a movable wedge (7) mounted sliding transversely on the inner face of the upper (2) and intended to be inserted between the end stop (5) and the rim (6) of the upper. The end stop may have a number of steps defining different slopes.

4 Claims, 2 Drawing Sheets

FIG.1
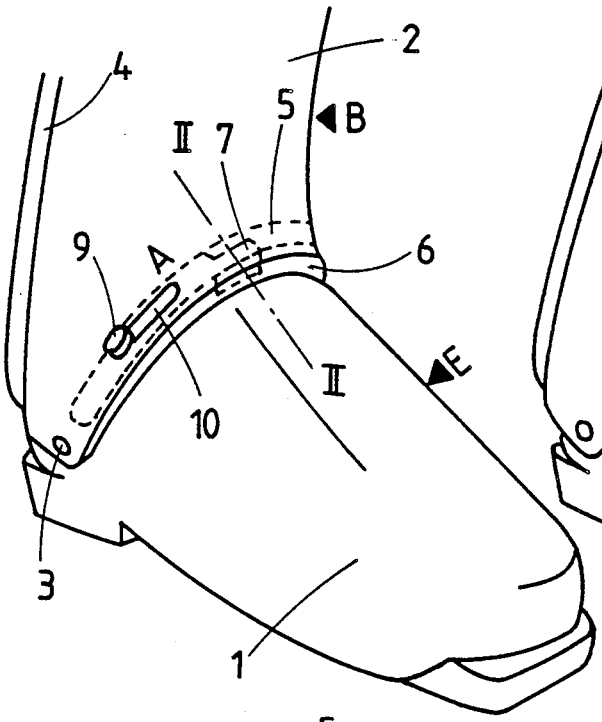
FIG. 5
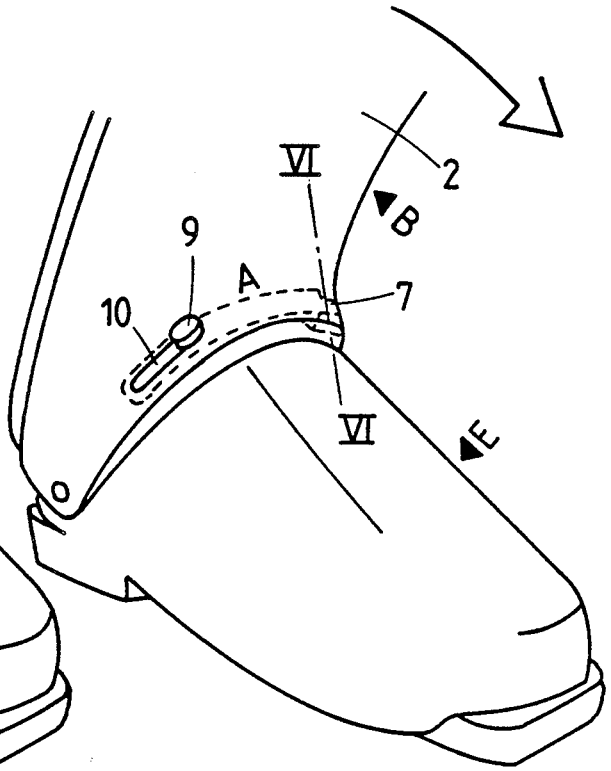
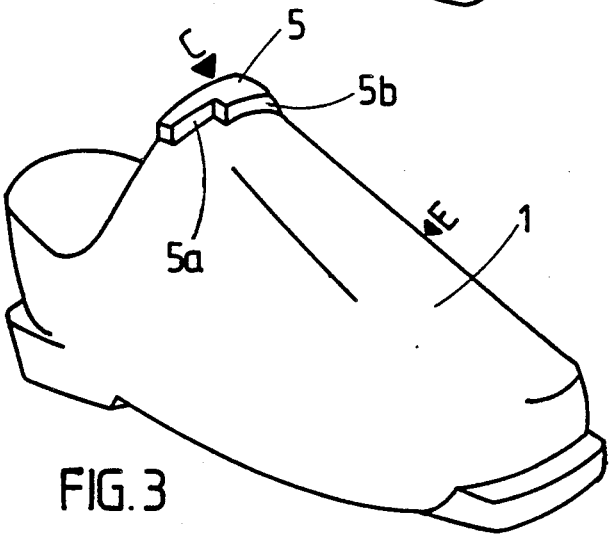
FIG. 3
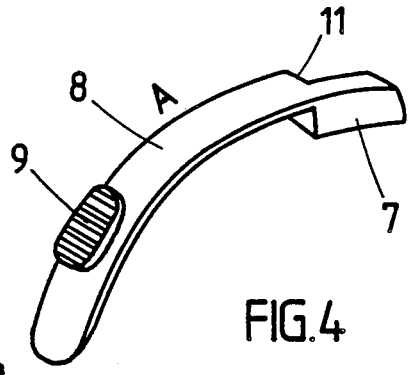
FIG.4

FIG. 2
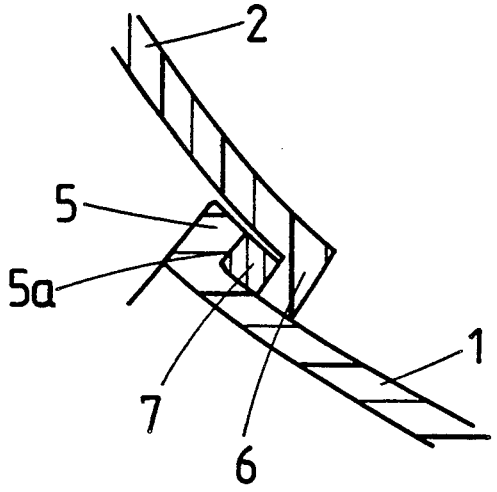
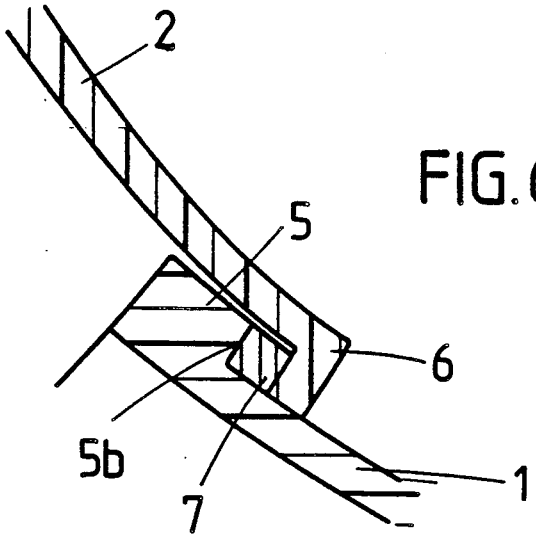
FIG. 6

SKI BOOT WITH SLOPE ADJUSTMENT

FIELD OF THE INVENTION

The present invention relates to a ski boot with a shell made of synthetic material consisting of a rigid shell bottom surrounding the foot and the heel and of an upper, in one or two parts, articulated onto the shell bottom, and comprising means for holding the upper in a sloping position and for modifying this slope.

PRIOR ART

In boots comprising an articulated upper, in particular rear-entry boots, it is judicious and known to provide means enabling the upper of the boot to be given a forward slope adapted to the type of skiing which is practised and to the skier's technique and abilities. U.S. Pat. No. 4,601,117 proposes a positioning device consisting of a swing-lever mounted on the front part of the upper and extending lengthwise in the direction of the front of the boot. This lever has a curved end which engages in one of the notches of a rack. A spring, which keeps the lever engaged, acts on the other end of the lever. Such a device requires, therefore, an articulation pivot and a spring. In addition, the rack is exposed to snow and ice and can be easily obstructed. Snow can also enter under the lever.

In U.S. Pat. No. 4,669,203 the adjusting device consists of a transverse threaded rod onto which is mounted a kind of pantograph whose other end is attached to a projection of the shell bottom. In this case, the adjusting device is sheltered, but it is relatively complex, with its rod threaded partly with a left-handed pitch and partly with a right-handed pitch and it is relatively fragile.

The objective of the present invention is to produce a device which is as simple as possible, requiring a minimum of moving parts and not involving either an articulation or a spring. In addition, the device must be well protected against snow and ice.

SUMMARY OF THE INVENTION

The ski boot according to the invention is distinguished by the fact that the means for holding the top in a sloping position and for modifying this slope consist of an end stop formed by a projection on the part of the shell bottom situated on the instep and overlapped by the corresponding part of the front part of the upper, of a transverse projecting part provided on the inner face of the front part of the upper overlapping the said end stop and interacting with this end stop to limit the upward travel of the upper, and of a movable wedge mounted sliding transversely on the inner face of the front part of the upper and intended to be inserted between the end stop and the projecting part of the upper to modify the slope of the upper.

Since the end stop and the projecting part of the upper originate from moulding with the shell bottom and the upper respectively, the only additional component consists of the movable wedge. The means for keeping the upper in a sloping position and for modifying its slope are therefore very simple, robust and well protected.

BRIEF DESCRIPTION OF THE DRAWINGS

The attached drawing shows, by way of example, an embodiment of the boot according to the invention.

FIG. 1 shows a view of it in perspective, from the front, in a first position of the upper.

FIG. 2 is a partial view in section along II—II of FIG. 1.

FIG. 3 shows, in perspective, the shell bottom alone.

FIG. 4 is a perspective view of the movable wedge.

FIG. 5 is a perspective view of the boot with the upper at another slope.

FIG. 6 is a partial view in section along VI—VI of FIG. 5.

DESCRIPTION OF THE PREFERRED EMBODIMENT

The boot shown comprises a shell bottom 1 made of rigid synthetic material and intended to surround the foot and the heel, and an upper consisting of a front part 2 articulated onto the shell bottom 1 by means of a rivet 3 and of an opposite rivet situated on the other side of the shell bottom, and of a rear part 4, also articulated onto the shell bottom at the same points as the front part of the upper or at different points, so that it fits into the front part 2. The boot shown is therefore of the rear-entry type.

Formed on the upper edge of the shell bottom 1 there is a projecting part 5 forming a stepped end stop with two steps 5*a* and 5*b* for the rim 6 of the front part 2 of the upper capable of straddling the upper part of the shell bottom 1 and cranked in the direction of the shell bottom 1 so as to be capable of hooking onto the end stop 5 when the intention is to raise the upper 2. On the inner face of the front part of the upper is mounted a movable wedge 7 extended by a semi-rigid tongue 8 provided with an actuating button 9 projecting over the boot through a slot 10 provided in the part 2 of the upper. The wedge 7 and the tongue 8 extend transversely along the rim 6 of the part 2 of the upper and rest against this rim 6, which acts as their means of guidance. The width of the wedge 7 is equal to the height of the step 5*b* relative to the step 5*a*. The wedge 7, more precisely its tongue 8, has a shoulder 11 extending perpendicularly to the direction of travel of the wedge and capable of abutting against the outer end of the step of the end stop 5 on which the movable wedge 7 rests. This shoulder 11 is used as an end stop and for lengthwise positioning of the movable wedge, in particular when the movable wedge 7 is on the step 5*b*, with the shoulder 11 then coming to abut against the end of this step 5*b*. In a first position of the wedge 7, shown in FIGS. 1 and 2, this wedge 7 is engaged on the step 5*a* of the end stop 5 and the rim 6 of the part 2 of the boot upper comes to rest against step 5*b* and against the wedge 7, which is level with the step 5*b*. The upper 2 slightly slopes.

When the button 9 is moved to the other end of the slot 10, as shown in FIG. 5, after having bent the upper forward, the wedge 7 moves into place between the step 5 and the rim 6 as shown in FIG. 6. The upper 2 is held in a position which is more sloping than the position shown in FIG. 1.

It is possible, of course, to increase the number of steps of the end stop 5 to obtain one or more intermediate positions. The movable wedge 7 can be fixed in its outermost positions and in its intermediate positions, respectively, by any suitable means. The simplest is a bayonet-type system.

A rigid or elastically deformable material can be envisaged for the manufacture of the wedge 7. The wedge may be a component which is added to the tongue 8 or an integral part.

The rim 6 could, of course, be replaced by a transverse rib which is set back from the lower edge of the part 2 of the upper.

I claim:

1. A ski boot with a shell made of synthetic material consisting of a rigid shell bottom (1) intended to surround the foot and the heel and of an upper, in one or two parts (2, 4), articulated onto the shell bottom, and comprising means for holding the upper in a sloping position and for modifying its slope, in which the means for holding the upper in a sloping position and for modifying its slope consist of an end stop (5) formed by a projection on the part of the shell bottom situated on the instep and overlapped by the corresponding part of the front part of the upper (2), of a transverse projecting part (6) provided on the inner face of the front part of the upper overlapping the said end stop and interacting with this end stop to limit the upward travel of the upper, and of a movable wedge (7) mounted sliding transversely on the inner face of the front part of the upper and intended to be inserted between the end stop (5) and the projecting part (6) of the upper to modify the slope of the upper, this wedge being provided with an actuating means (9) accessible through the upper.

2. The boot according to claim 1, wherein the said end stop (5) has a number of steps (5*a*, 5*b*) defining different slopes.

3. The boot according to claim 1, wherein the projecting part of the upper is formed by a rim (6) thereof and the movable wedge (7) is guided sideways by this rim.

4. The boot according to claim 3, wherein the movable wedge (7) has a positioning shoulder (11) capable of abutting against the outer end of the step on which the wedge rests.

* * * * *